US005364221A

United States Patent [19]

Theurer et al.

[11] Patent Number: 5,364,221

[45] Date of Patent: Nov. 15, 1994

[54] TRACK-BOUND FREIGHT CAR

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 216,098

[22] Filed: Mar. 22, 1994

Related U.S. Application Data

[63] Continuation of Ser. No. 806,873, Dec. 12, 1991, abandoned.

[30] Foreign Application Priority Data

Feb. 27, 1991 [AT] Austria ..... A411/91

[51] Int. Cl.[5] ..... B65G 67/00

[52] U.S. Cl. ..... 414/339; 414/528; 414/505; 414/346; 104/2; 198/303; 198/317

[58] Field of Search ..... 414/339, 334, 335, 340, 414/343, 345, 346, 349, 350, 351, 527, 528, 398, 523, 391, 392, 502, 503, 504, 505; 198/303, 317, 318, 587, 525, 836; 104/2, 3

[56] References Cited

U.S. PATENT DOCUMENTS

| | | | |
|---|---|---|---|
| 1,518,759 | 12/1924 | Sayers | 414/339 |
| 2,798,587 | 7/1957 | Bergmann | 198/303 |
| 2,856,062 | 10/1958 | Kling | 198/317 |
| 3,307,718 | 3/1967 | Sjöström | 198/303 X |
| 3,552,586 | 1/1971 | Edlund | 414/339 |
| 3,842,994 | 10/1974 | Theurer et al. . | |
| 4,576,538 | 3/1986 | Theurer et al. . | |
| 4,809,617 | 3/1989 | Theurer et al. | 414/502 X |

FOREIGN PATENT DOCUMENTS

| | | | |
|---|---|---|---|
| 368046 | 5/1990 | European Pat. Off. . | |
| 1267166 | 4/1968 | Germany | 198/318 |
| 120161 | 11/1947 | Sweden | 414/346 |
| 176111 | 7/1961 | Sweden | 414/344 |

*Primary Examiner*—Frank E. Werner
*Attorney, Agent, or Firm*—Collard & Roe

[57] ABSTRACT

A track-bound freight car comprises a longitudinally extending machine frame, an undercarriage at each machine frame end, a conveyor band extending obliquely with respect to the track plane and above the machine frame in the longitudinal direction of the machine frame, the conveyor band having a lower input end above one of the undercarriages and a higher output end above the other undercarriage. At least one of the conveyor band ends is displaceable transversely to the longitudinal direction with respect to the undercarriage at said one conveyor band end and a transverse displacement drive is connected to the one conveyor band end for effectuating the displacement. Parallel side walls extend in the longitudinal direction along the conveyor band, the conveyor band constituting the bottom of a storage space defined between the side walls.

13 Claims, 2 Drawing Sheets

Fig. 3
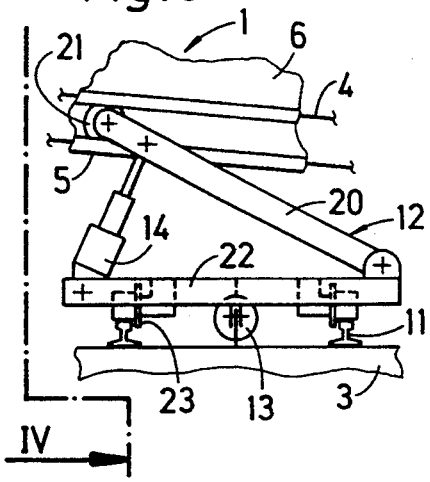
Fig. 4
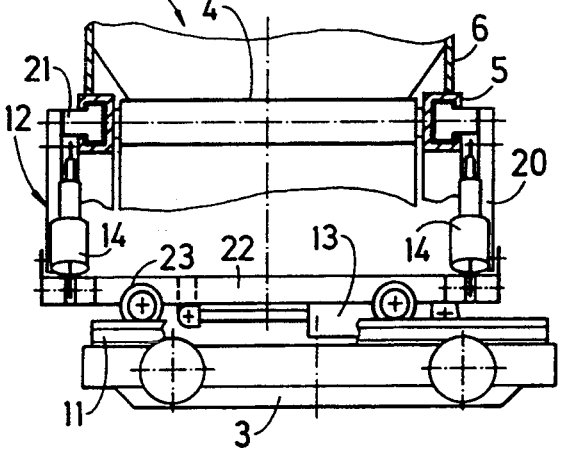
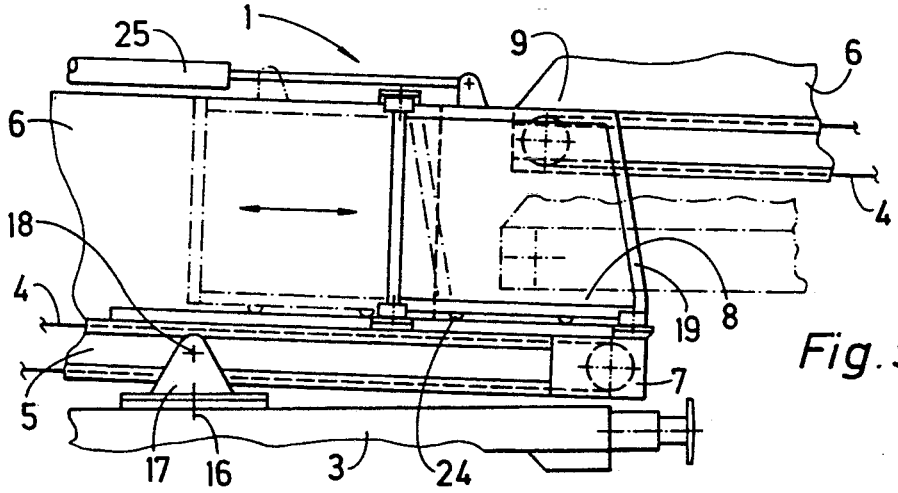
Fig. 5
Fig. 6
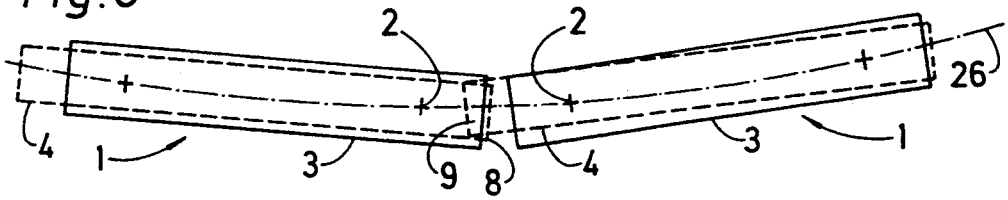
Fig. 7
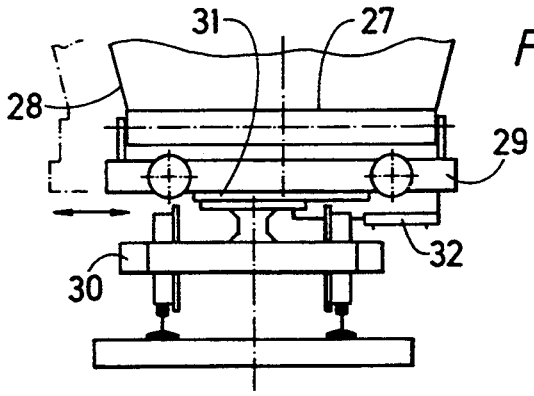

TRACK-BOUND FREIGHT CAR

CROSS-REFERENCE TO RELATED APPLICATION

This is a continuation of our copending U.S. patent application Ser. No. 07/806,873, filed Dec. 12, 1991, now abandoned.

BACKGROUND OF THE INVENTION

1. Field of the Invention

The present invention relates to improvements in a track-bound freight car comprising a longitudinally extending machine frame having opposite ends, an undercarriage at each machine frame end and supporting the machine frame on a track defining a plane, a conveyor band extending obliquely with respect to the track plane and above the machine frame in the longitudinal direction of the machine frame, the conveyor band having a lower input end above one of the undercarriages and a higher output end above the other undercarriage, and parallel side walls extending in the longitudinal direction along the conveyor band, the conveyor band constituting the bottom of a storage space defined between the side walls.

2. Description of the Prior Art

A track-bound freight car of this type has been disclosed in European patent application No. 368,046, published May 16, 1990. The higher output or discharge end of the conveyor band projects beyond the end of the machine frame so that it is disposed above the lower input end of the conveyor band in a succeeding freight car. In this way, the conveyor bands of a plurality of freight cars coupled together to form a train will provide a continuous conveyance path for loading and unloading bulk material. To provide a maximum storage capacity for the bulk material in each freight car, the vertical distance between the lower input end and the higher output end of the conveyor band substantially equals the height of the side walls. In track curves, problems arise in the proper transfer of the bulk material from the higher output end of one conveyor band to the lower input end of the succeeding conveyor band since the projecting output end is farther removed from the center of the track.

In a similar freight car disclosed in U.S. Pat. No. 4,576,538, the conveyor band has a lower input section extending along the bottom and an output section rising obliquely from the input section. This freight car, too, has the indicated problems in track curves.

U.S. Pat. No. 3,842,994 discloses a different type of freight car comprising a storage bin for bulk material and a multi-part overhead conveyor arrangement extending over the open top of the storage bin and extensible so that a selected end of the conveyor arrangement may project beyond the open top of the storage bin to overlap an adjacent end of a like overhead conveyor arrangement on an adjacent freight car. While this is not illustrated, it is mentioned that the overhead conveyor arrangement may be mounted for lateral displacement transversely to the track for proper operation in track curves.

SUMMARY OF THE INVENTION

It is the primary object of this invention to improve a freight car of the first-described type so that bulk material may be transferred without problems in track curves from the output end of a conveyor band in one car to the input end of a conveyor band in a car preceding the one car in the conveying direction of the bulk material.

The above and other objects are accomplished according to the invention in such a freight car by arranging at least one of the conveyor band ends displaceable transversely to the longitudinal direction with respect to the undercarriage at the one conveyor band end, and comprising a transverse displacement drive connected to the one conveyor band end for effectuating the displacement.

This enables the displaceable conveyor band end to be displaced transversely to the longitudinal direction with respect to the center of the track so that the output end of the conveyor band of one freight car will overlap the input end of the conveyor band of an adjoining car when the cars travel in a track curve. Suitable transverse displacement will assure such an overlapping relationship of the adjoining conveyor band ends even in sharp curves. Such a transverse displacement will further eliminate the problem created by the superelevation of the track in curves since the bulk material being discharged centrally from the higher output end will fall eccentrically along a vertical line on the lower input end of the adjoining conveyor band. The output end may be correspondingly transversely displaced until the discharged bulk material will fall on the center of the adjoining input end despite the superelevation of the track.

According to a preferred feature of the present invention, the higher output end of the conveyor band end is transversely displaceable, the transverse displacement drive is connected to the higher conveyor band output end, and the lower input end of the conveyor band is mounted on the machine frame for rotation about a substantially vertical axis. This has the advantage that the conveyor band output end, which projects a substantial distance from the track center in track curves, can be centered exactly over the input end of the adjoining conveyor band, which remains transversely centered with respect to the track.

According to one embodiment of this invention, the freight car further comprises at least one rail affixed to the machine frame and extending transversely to the longitudinal direction, and a support frame guided on the rail for transverse displacement and connected to the transversely displaceable conveyor band end for support thereof. The undercarriage at the transversely displaceable conveyor band end preferably is a swivel truck comprising a pivot for rotating the swivel truck with respect to the machine frame, and two of such rails extend parallel to each other and are equidistantly spaced from the pivot. Such a structure provides a transverse displaceability without problems and securely supports the conveyor band on the machine frame.

Advantageously, the support frame is a carriage having flanged rollers supporting the carriage on the rails, and the transverse displacement drive connects the carriage to the machine frame. This provides a particularly simple and solid structure for the transverse displacement of the higher output end of the conveyor band.

A very simple and solid structure will be provided by linking the lower ends of two parallel bracing members, which extend in the longitudinal direction obliquely to the machine frame, to the support frame while their upper ends support the conveyor band output end. The conveyor band may comprise a carrier frame and the upper bracing member ends may carry flanged rollers engaging guides extending on the carrier frame in the longitudinal direction. A lifting drive for vertically adjusting the output end of the conveyor band may connect the conveyor band output end to the support frame. In this combination of the lifting drive and the transverse displacement drive, the conveyor band will be securely supported on the machine frame in every vertically and transversely adjusted position.

If the lower input end of the conveyor band is mounted on a turntable for rotation about the substantially vertical axis, the stress caused by the transverse displacement due to the oblique extension of the conveyor band will be readily transferred to the machine frame without interfering with the transverse displacement.

According to another embodiment of this invention, the undercarriage at the end where the conveyor band end is transversely displaceable with respect thereto is transversely displaceably mounted on the machine frame for displacement in a direction extending perpendicularly to the longitudinal direction, and the transverse displacement drive is connected to this undercarriage. Whether the conveyor band end itself is transversely displaceable relative to the machine frame or not, this embodiment enables the conveyor band end to be transversely displaced relative to the track with the machine frame on which it is mounted. Therefore, the output end of the conveyor band may be properly centered in track curves over the adjoining input end of a conveyor band in a preceding freight car to assure the proper transfer of the conveyed bulk material from one car to the next car.

The side walls may have an end portion adjacent the lower input end of the conveyor band and these side wall end portions are constituted by sliding doors slidable in the longitudinal direction in planes extending parallel to the side walls. A sliding drive is connected to each sliding door. This arrangement enables the transverse displacement of the projecting conveyor band output end in track curves to be effected without hindrance.

A lifting drive is preferably connected to the higher output end of the conveyor band for vertically adjusting the conveyor band with respect to the machine frame. This makes it possible to adjust the elevation of the conveyor band output end to a desired depth of the bulk material in the storage space. For example, if the bulk material is merely conveyed from car to car in a freight train, the output ends of the sequentially arranged conveyor bands may be lowered to a level at which they just overlie the input ends of the adjoining conveyor bands. On the other hand, if the bulk material is to be stored in a car, the output end of its conveyor band is raised until the bulk material in the car reaches a desired level. If the conveyor band output end projects beyond the machine frame in the longitudinal direction, its lifting will be facilitated if the input end of the conveyor band is pivotally mounted on the machine frame for pivoting about an axis extending transversely to the longitudinal direction.

Finally, the track-bound freight car may further comprise a support for the input end of the conveyor band, the support being mounted on the machine frame for rotation about a vertical axis and the conveyor band input end being pivoted to the support for pivoting about an axis extending transversely to the longitudinal direction. This provides a stable support for the conveyor band on the machine frame while enabling the higher output end of the conveyor band to be readily displaced vertically and transversely.

BRIEF DESCRIPTION OF THE DRAWING

The above and other objects, advantages and features of the present invention will become more apparent from the following detailed description of certain now preferred embodiments thereof, taken in conjunction with the accompanying somewhat schematic drawing wherein

FIG. 3 is an enlarged fragmentary side view showing a support carriage and lifting drive for the conveyor band output end;

FIG. 4 is an end view of the support carriage and lifting drive, as seen in the direction of arrow IV of FIG. 3;

FIG. 5 is an enlarged fragmentary side view showing the end of the freight car at the input end of its conveyor band, and a higher output end of the conveyor band in an adjoining freight car;

FIG. 6 is a diagrammatic top view of two adjoining freight cars in a track curve; and FIG. 7 is a fragmentary end view of a freight car with a transversely displaceable undercarriage.

DETAILED DESCRIPTION OF PREFERRED EMBODIMENTS

Figure 1:
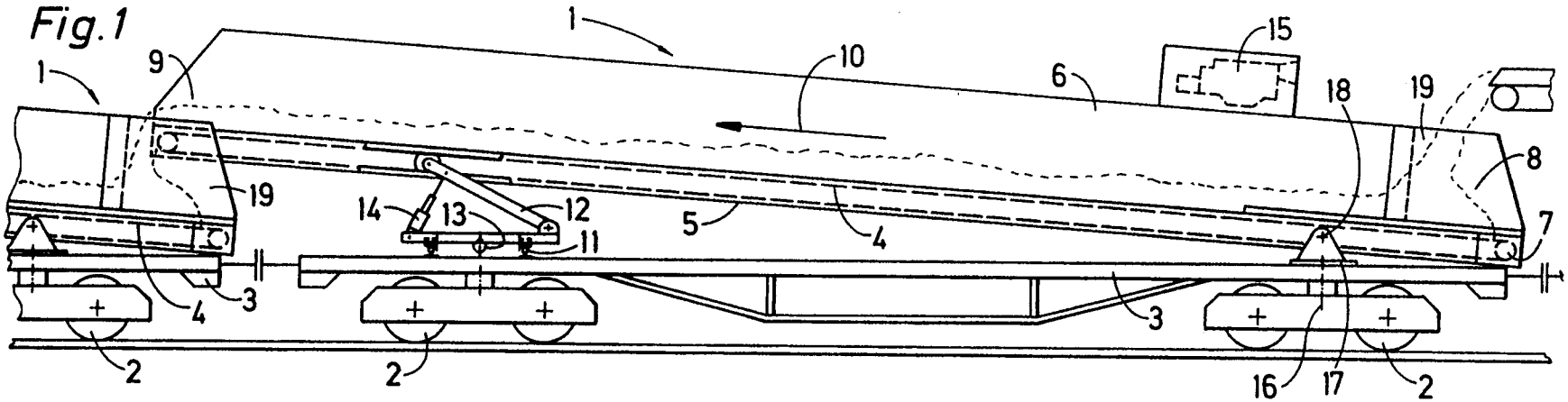
FIG. 1 is a side elevational view showing a freight car according to one embodiment of this invention, with the higher output end of its conveyor band in a raised position.
Figure 2:
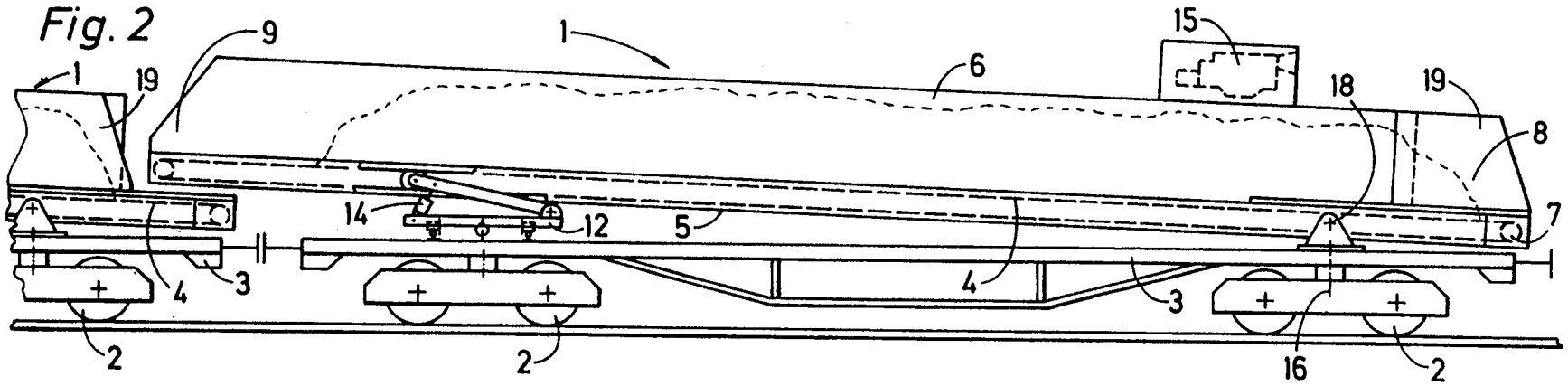
FIG. 2 is a like view, showing the conveyor band output end lowered during transit.

Referring now to the drawing and first to FIGS. 1 and 2, there is shown track-bound freight car 1 comprising longitudinally extending machine frame 3 having opposite ends and an undercarriage 2, 2 at each machine frame end and supporting the machine frame on a track defining a plane. Conveyor band 4 is held in carrier frame 5 and extends obliquely with respect to the track plane and above machine frame 3 in the longitudinal direction of the machine frame. The conveyor band has a lower input end 8 above one of the undercarriages 2 and a higher output end 9 above the other undercarriage. Conveyor band 4 is an endless conveyor band driven by variable speed motor 7 in a conveying direction indicated by arrow 10. Conveyor band end 9 is displaceable transversely to the longitudinal direction with respect to undercarriage 2 at that end, and transverse displacement drive 13 is connected to the higher conveyor band output end for effectuating the displacement. Parallel side walls 6 extend in the longitudinal direction along conveyor band 4, the conveyor band constituting the bottom of a storage space defined between the side walls. Engine 15 is mounted on car 1 for supplying energy to all the operating drives.

Conveyor band output end 9 projects beyond machine frame 3 in the longitudinal direction and the input end of the conveyor band is pivotally mounted on the machine frame for pivoting about an axis extending transversely to the longitudinal direction and lower input end 8 of the conveyor band is mounted on the machine frame for rotation about substantially vertical axis 16. Higher conveyor band output end 9 projects sufficiently beyond machine frame 3 that it overlies lower input end 8 of a like conveyor band in a like succeeding freight car so that, as indicated in broken lines, the conveyed bulk material falls from the output end onto the input end. Any number of such freight cars may be coupled together to form a freight train.

In the illustrated embodiment, a turntable or rotary mount support 17 for the input end of the conveyor band is mounted on machine frame 3 for rotation about axis 16 and conveyor band input end 8 is pivoted to support 17 for pivoting about axis 18 extending transversely to the longitudinal direction.

As best shown in FIGS. 3 and 4, two rails 11 are affixed to machine frame 3 and extend transversely to the longitudinal direction, and support frame 12 is guided on rail 11 for transverse displacement and is connected to transversely displaceable conveyor band end 9 for support thereof. Undercarriage 2 at transversely displaceable conveyor band end 9 is a swivel truck comprising a pivot for rotating the swivel truck with respect to machine frame 3, guide rails 11 extending parallel to each other and being equidistantly spaced from the pivot. The illustrated support frame 12 is a carriage comprising carrier 22 having four flanged rollers 23 supporting the carrier on rails 11, and transverse displacement drive 13 connects the carriage to machine frame 3.

Furthermore, two parallel bracing members 20 extend in the longitudinal direction obliquely to machine frame 3, the bracing members having lower ends linked to carrier 22 of support frame 12 and upper ends supporting conveyor band output end 9. The upper bracing member ends carry flanged rollers 21 engaging guides extending on carrier frame 5 of the conveyor band in the longitudinal direction in the plane of the conveyor band. Lifting drive 14 connects conveyor band output end 9 to support frame 12 for vertically adjusting the output end of the conveyor band with respect to machine frame 3. As shown in FIG. 4, actuation of transverse displacement drive 13 connected to machine frame 3 causes a transverse displacement of support frame 12, carrier frame 5 with conveyor band 4 and side walls 6 with respect to the longitudinal center axis of machine frame 3. This transverse displacement depends on the radius of the track curve and can be effected independently of the vertical adjustment by lifting drive 14 as well as the conveyance speed controlled by drive 7.

As shown in FIG. 5, side walls 6 have an end portion adjacent lower input end 8 of conveyor band 4, the end side wall portions being constituted by sliding doors 19 slidable in the longitudinal direction in planes extending parallel to the side walls. Sliding drive 25 is connected to each sliding door which is mounted on rollers 24 for sliding between a rear operating position shown in full lines and a forward transit position shown in phantom lines. As shown in FIG. 2, in the lowered position of output end 9 of conveyor band 4 during transit, sliding doors 19 along side walls 6 are slid forwardly to open the end side wall portions adjacent output end 9 of a succeeding car 1 so that this output end may be transversely displaced without hindrance when the cars travel in a track curve whose path is indicated by phantom line 26 in FIG. 6. The projecting output ends of conveyor bands 4 (shown in broken lines) are clearly transversely offset relative to machine frames 3 (shown in full lines) so that the output end of each conveyor band will lie above and in registry with the input end of the succeeding conveyor band in the track curve.

FIG. 7 illustrates another embodiment, wherein undercarriage 30 at the output end of conveyor band 27 is transversely displaceably mounted on machine frame 29 for displacement in a direction extending perpendicularly to the longitudinal direction, and transverse displacement drive 32 is connected to undercarriage 30. As in the first-described embodiment, side walls 28 define a storage space with the conveyor band extending at the bottom thereof and, if desired, a lifting drive may be provided for the conveyor band end. The underside of machine frame 29 has a transverse guide 31 and undercarriage 30 is slidably mounted in the transverse guide. In this embodiment, the machine frame with the conveyor band output end is transversely displaced with respect to the undercarriage.

The freight car may be used in a train in which a succession of such cars are coupled together and operates in the following manner:

While the train is in transit to an operating site, conveyor bands 4 are in their lowered position illustrated in FIG. 2. In this position, sliding doors 19 at input ends 8 of the conveyor bands are in their forward end position (see phantom lines in FIG. 5) so that output ends 9 of the succeeding conveyor bands, which project over the preceding input ends, may be transversely displaced unhindered when the train travels in track curves (see FIG. 6). At the operating site, a ballast cleaning machine may be operated to excavate and clean ballast, in which operation waste material is separated from the cleaned ballast, and this waste material may be conveyed to rearmost car 1 of the train to be discharged on input end 8 of its conveyor band 4 (as shown at the right end of FIG. 1). Drives 7 of the conveyor bands of the successive freight cars 1 are now operated so that the waste bulk material is conveyed in the direction indicated by arrow 10 and is transferred from car to car, i.e. from projecting output end 9 of each conveyor band 4 to underlying input 8 of the preceding conveyor band until the conveyed bulk material has reached the foremost car. The output end of the conveyor band in second car 1 immediately succeeding the foremost car is raised by lifting drive 14 to a height determining the level of the bulk material stored in the storage space defined by side walls 6 of the foremost car to fill this storage space. At the same time, sliding doors 19 in the side walls of the foremost car are closed to assume their rear end position (see FIG. 1 and full lines in FIG. 5). To fill the storage space in the second car, the conveyor band is lowered and the conveyor band in the immediately succeeding car is raised, and this operation is repeated to fill the storage spaces in the successive cars of the train.

When the train travels in a track curve during the continuous storing operation, the higher output ends of the conveyor bands are transversely displaced by operation of drive 13 (or 32) until each projecting conveyor band output end 9 is centered over preceding lower conveyor band input end 8. The operation of the transverse displacement drives may be automatically controlled, for example by limit switches mounted on sliding doors 19 and contacting the conveyor band output ends. The storage spaces in freight cars 1 are charged with bulk material only up the forward edges of sliding doors 19, i.e. no bulk material is stored in the cars in the area of the closed sliding doors so that, when these doors are opened, no bulk material will spill out of the cars.

While the embodiment illustrated in FIGS. 1 to 5 shows the higher output end 9 of conveyor band 4 to be transversely displaceable, the lower conveyor band input end 8 may be made transversely displaceable instead while the forward output end is stationary in a transverse direction. With such an embodiment, the unhindered transfer of the conveyed bulk material from a conveyor output end to a preceding conveyor input end will be assured in track curves by transversely displacing the conveyor input end until it is centered below the output end.

What is claimed is:

1. A track-bound freight car in combination with a like adjoining freight car and comprising (a) a machine frame having opposite ends and extending in a longitudinal direction, (b) a wheeled undercarriage at each machine frame end and supporting the machine frame on a track defining a plane, (c) a conveyor band extending obliquely with respect to the track plane and above the machine frame in the longitudinal direction, (1) the conveyor band having a conveying surface for conveying bulk material, (2) a lower input end above one of the undercarriages for receiving the bulk material, and (3) a higher output end above the other undercarriage for discharging the bulk material, the higher output end projecting from one of the machine frame ends in the longitudinal direction a sufficient distance to overly the lower conveyor band input end of the adjoining freight car, (d) drive means for driving the conveyor band for conveying the bulk material from the input end to the output end, (e) a separate carrier frame for the conveyor band, the separate carrier frame being mounted on the machine frame and including (1) parallel side walls extending in the longitudinal direction alongside the conveyor band, (2) the conveyor band constituting a bottom of a storage space for the bulk material defined between the side walls, (f) means for mounting respective ends of the carrier frame on the machine frame at the conveyor band ends, (1) the carrier frame and the conveyor band being horizontally displaceable transversely to the longitudinal direction at least at one of the ends with respect to the undercarriage at said one end, and (2) the carrier frame end at the lower input end of the conveyor band being mounted on the machine frame for rotation about a substantially vertical axis, (g) a transverse displacement drive connected to the one end for effectuating the displacement, and (h) a coupling of fixed length in the longitudinal direction for coupling the freight car to the adjoining freight car.

2. The track-bound freight car of claim 1, wherein the carrier frame end at the higher output end of the conveyor band is transversely displaceable, the transverse displacement drive is connected to the carrier frame end at the higher conveyor band output end.

3. The track-bound freight car of claim 2, further comprising at least one rail affixed to the machine frame and extending transversely to the longitudinal direction, and a support frame guided on the rail for transverse displacement and connected to the transversely displaceable carrier frame end for support thereof.

4. The track-bound freight car of claim 3, wherein the undercarriage at the transversely displaceable carrier frame end is a swivel truck comprising a pivot for rotating the swivel truck with respect to the machine frame, further comprising two of said rails extending parallel to each other at respective sides thereof, and equidistantly spaced from, the pivot.

5. The track-bound freight car of claim 4, wherein the support frame is a carriage having flanged rollers supporting the carriage on the rails, and the transverse displacement drive connects the carriage to the machine frame.

6. The track-bound freight car of claim 3, further comprising a lifting drive for vertically adjusting the output end of the conveyor band, the lifting drive connecting the carrier frame and at the conveyor band output end to the support frame.

7. The track-bound freight car of claim 3, wherein the support frame comprises a carrier and two parallel bracing members extending in the longitudinal direction obliquely to the machine frame, the bracing members having lower ends linked to the support frame carrier and upper ends supporting the carrier frame end at the conveyor band output end.

8. The track bound freight car of claim 7, whether the upper bracing member ends carry flanged rollers engaging guides extending on the carrier frame in the longitudinal direction.

9. The track-bound freight car of claim 2, further comprising a turntable mounting the carrier frame end at the lower input end of the conveyor band for rotation about the substantially vertical axis.

10. The track-bound freight car of claim 1, wherein the side walls have an end portion adjacent the lower input end of the conveyor band, the end side wall portions being constituted by sliding doors slidable in the longitudinal direction in planes extending parallel to the side walls.

11. The track-bound freight car of claim 10, further comprising a sliding drive connected to each sliding door.

12. The track-bound freight car of claim 1, further comprising means for mounting the undercarriage at said one end transversely displaceably on the machine frame for displacement in a direction perpendicularly to the longitudinal direction, the transverse displacement drive being connected to said transversely displaceable undercarriage.

13. The track-bound freight car of claim 1, wherein the mounting means comprises a support for the carrier frame end at the conveyor band input end, the support being mounted on the machine frame for rotation about a vertical axis and the carrier frame end at the conveyor band input end being pivoted to the support for pivoting about an axis extending transversely to the longitudinal direction.

* * * * *